US005557914A

United States Patent [19]

Maccaferri

[11] Patent Number: 5,557,914

[45] Date of Patent: Sep. 24, 1996

[54] TWISTING MACHINE WITH EXTERNAL AND INTERNAL CONTROL PANELS

[75] Inventor: Angelo Maccaferri, Bologna, Italy

[73] Assignee: S.A.M.P. S.p.A. Meccanica di Precisione, Bologna, Italy

[21] Appl. No.: 383,858

[22] Filed: Feb. 6, 1995

[30] Foreign Application Priority Data

Feb. 7, 1994 [IT] Italy ..... BO94A0047

[51] Int. Cl.[6] ..... D01H 1/10; D01H 7/46

[52] U.S. Cl. ..... 57/58.65; 57/58.67; 57/66.5; 57/100; 57/264

[58] Field of Search ..... 57/264, 58.65, 57/58.67, 58.68, 66.5, 100

[56] References Cited

U.S. PATENT DOCUMENTS

| | | | |
|---|---|---|---|
| 2,736,161 | 2/1956 | Nystrom | 57/100 |
| 2,873,569 | 2/1959 | Schinke et al. | 57/100 |
| 2,933,880 | 4/1960 | Pharo | 57/100 |
| 4,628,676 | 12/1986 | Lepach et al. | 57/58.67 |

FOREIGN PATENT DOCUMENTS

| | | | |
|---|---|---|---|
| 2206094 | 9/1987 | Japan | 57/58.65 |
| 2130612 | 6/1984 | United Kingdom . | |

*Primary Examiner*—William Stryjewski
*Attorney, Agent, or Firm*—Larson and Taylor

[57] ABSTRACT

On the cradle (9) of the twisting machine there is mounted a control panel (38) powered externally through a first slip ring (37-137) and corresponding electrical lines (35-135-235). In the control panel there is located an electronic computer (39) which controls the operation of all the internal components of the twisting machine and which, through at least one serial line (41-141) and a second slip ring (42-142), is connected to an electronic computer (40) located in the control panel which is disposed outside the twisting machine. The electronic computer (40) is associated with a keyboard and screen unit (43) for the programming and interrogation of the computers. An electrical power supply line (35) is linked to the external panel and the mechanism for supply and control of the external components of the twisting machine are provided in this panel. During operation, all the internal components of the twisting machine are controlled autonomously by the internal control panel, while the internal computer (39) communicates with the external computer (40) through the serial lines to ensure that the external components of the twisting machine operate in phase and in sequence with the internal components.

3 Claims, 3 Drawing Sheets

TWISTING MACHINE WITH EXTERNAL AND INTERNAL CONTROL PANELS

FIELD OF THE INVENTION

The invention relates to a twisting machine with internal gathering, with a winder with electronically controlled speed and with a slip ring system with a small number of components. More particularly, the invention relates to large twisting machines used for the production of wire cables and ropes, especially for cables and ropes for electrical use, by the twisting of aluminium or copper wires.

BACKGROUND OF THE INVENTION

Twisting machines with internal gathering are basically divided into two categories, according to the system used to drive the twisted product winder reel. The reel may be rotated by a constant-speed motor with the interposition of a torque limiter, or by a motor whose speed is variable automatically by means which detect the progressively increasing diameter of the winding on the reel and/or by means which detect variations in longitudinal tension of the twisted product being wound, which for this purpose is run around tensioning means of what is known as the idler type. With twisting machines of the latter type it is possible to avoid undesirable tensions in the twisted products and to keep the electrical conductivity of the wires used unchanged, a condition which is difficult to obtain with twisting machines of the first type.

The production and use of twisting machines of the second type is at present beset by considerable technical difficulties which make it necessary to fall back on twisting machines of the first type the technical difficult are essentially due to the difficulty of producing a reliable electrical connection through slip rings and brushes between the electronic computer disposed in the external control panel of the twisting machine and the various motors and numerous safety and control devices required to control not only the winder reel but also the traversing device and the various mechanisms contributing to the operation of the said type of internal winder. To provide the necessary connection between the internal devices of the twisting machine and the external power supply and control panel, it is at present necessary to provide a slip ring system with a very high number of rings with considerable elongation of the twisting machine. It is then necessary to transmit, through the rings and brushes, electrical signals which may be distorted in an unpredictable way by disturbances arising from the sliding contact between the said brushes and the rings of the slip ring system.

SUMMARY OF THE INVENTION

The invention is intended to overcome these and other problems encountered in the production of a twisting machine with internal gathering and in particular of a twisting machine of the second type, with the following concept of a solution. An internal control panel with an electronic computer which controls the power supply and operation of the various internal devices of the twisting machine is mounted on the fixed part, namely the cradle, which carries the said devices of the twisting machine. This internal panel is connected to an external control panel, which is disposed outside the twisting machine and which is also provided with an electronic computer, through at least one slip ring and brush system with a sufficient number of components for linking to an alternating current power supply line for example a three-phase line. The internal and external control panels are also connected by to a two-wire line which is used as a serial line to establish the necessary link between the electronic computer, which is disposed in the external control panel and is associated with a keyboard for programming and interrogation, and the electronic computer disposed in the internal control panel. Together the internal computer and the external computer provide the logical control of the operation of the winder and of the whole twisting machine.

In order to ensure the maximum degree of safety in the twisting machine, the two control panels are interconnected through at least one other two-wire line, with a corresponding slip ring, which permits the activation at the correct time of safety means to stop the twisting machine in case of malfunction.

BRIEF DESCRIPTION OF THE DRAWING

Further characteristics of the invention, and the advantages derived therefrom, will be clearly understood from the following description of a preferred embodiment of the invention, illustrated solely by way of example and without restriction, in the figures on the three attached sheets of drawings, in which.

DESCRIPTION OF THE PREFERRED EMBODIMENTS

Figure 1:
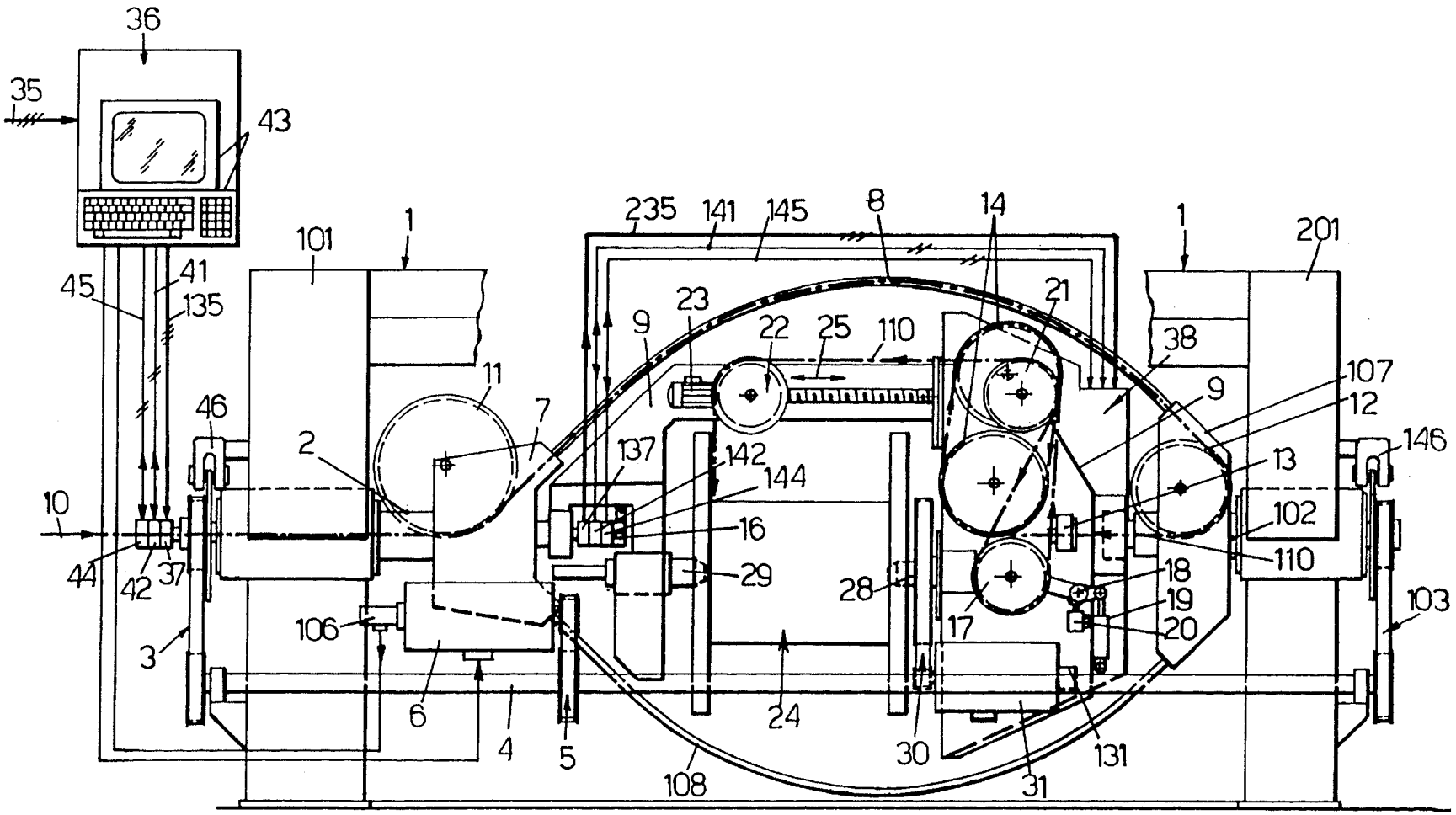
FIGS. 1 and 2 are schematic views, in side elevation and in front elevation respectively, of the twisting machine according to the invention.
Figure 2:
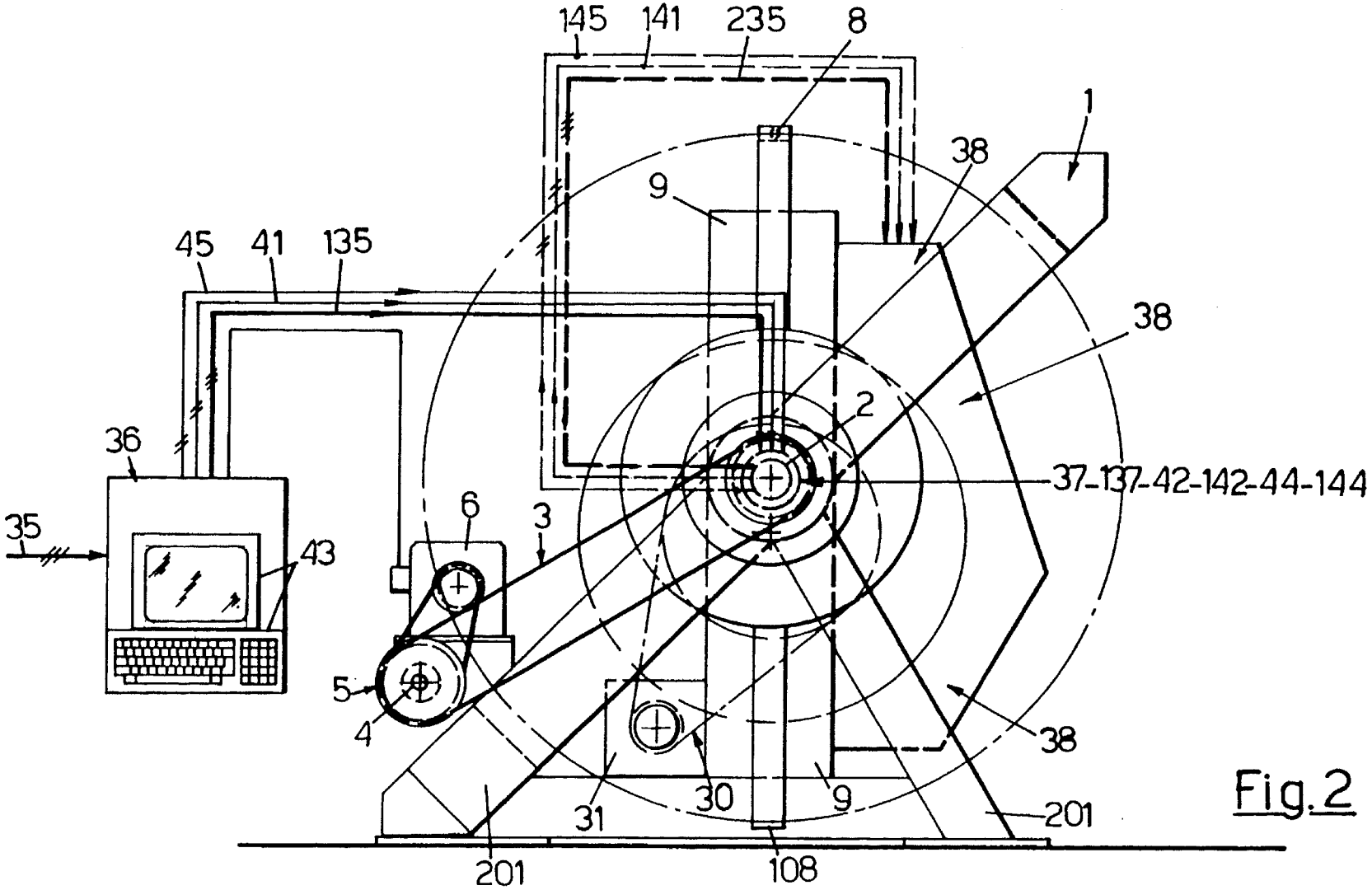

In FIGS. 1 and 2, the number 1 indicates the frame of the twisting machine which rotatably supports, with the opposing parts 101 and 201, two horizontal spindles 2-102, aligned axially with each other. Spindles 2-102 are connected by corresponding positive transmissions 3-103 to a common shaft 4, parallel to them. Shaft 4 is also supported rotatably by the frame 1 and is connected by a positive transmission 5 of motion to a direct current electric motor 6, with a brake and with an encoder 106. The conical structures 7-107 which support the ends of a pair of wire guide flyers 8-108. Wire guide flyers 8-108 are curved and at an angle of 180° to each other, are fixed on the portions of the spindles 2-102 disposed inside the frame 1. The said inner ends of the spindles support, with the interposition of bearings, the ends of a fixed and suitably ballasted structure 9, called the cradle, on which are disposed the means for driving and the means for winding the twisted product.

Figure 3:
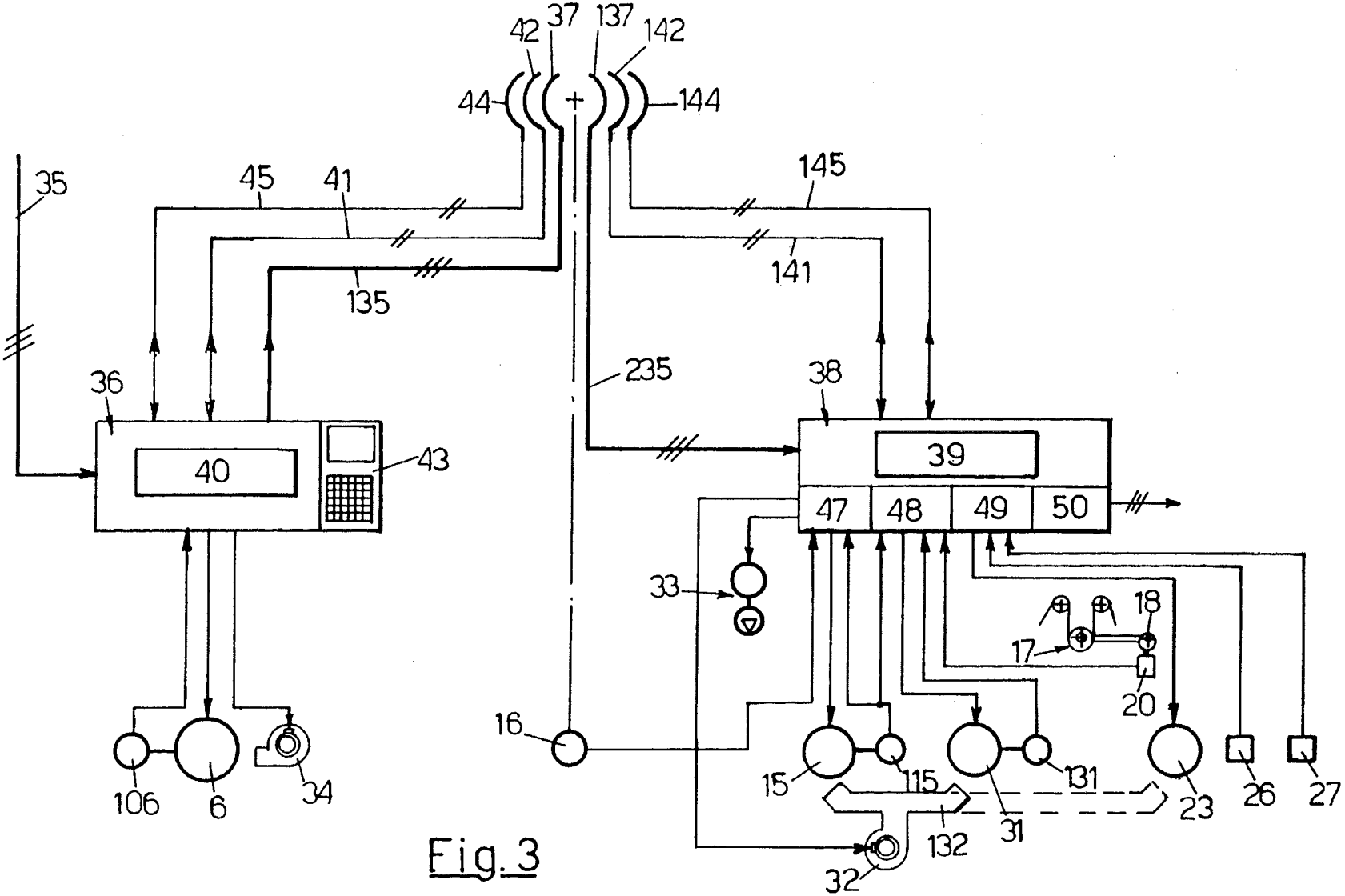
FIG. 3 hows a schematic circuit diagram of the twisting machine.

The wires 10 to be twisted pass axially through the spindle 2, exit laterally from an intermediate part of the spindle, and are sent to a wire guide pulley 11 supported rotatably by the structure 7. The wire then pass longitudinally along the flyer 8, reach the wire guide pulley 12 supported rotatably by the structure 107, enter the spindle 102 and leave it axially from the end inside the twisting machine, where they pass through a compacting drawplate 13 mounted on the cradle 9. On leaving the drawplate, the twisted product 110 is wound with a number of turnings around the double capstan 14 rotatably supported by the cradle 9 and driven by the direct current electric motor 15 with a brake and with an encoder 115 (FIG. 3). Since the speed of the motor 15 has to be matched to that of the rotation of the twisting mechanism, an encoder 16 (FIGS. 1–3) is fixed to the cradle 9 and detects the number of revolutions of the spindle 2. The encoder than sends an electrical signal proportional to this number of revolutions, and is used in the way stated below. On leaving the double capstan 14, the twisted product is sent to the wire guide pulley of the idler 17 pivoted at 18 on the cradle 9. Idler 17 is connected to a balancing and damping device 19 and combined with a transducer 20 (FIG. 3) which sends an electrical signal varying with a variation in the angular position of the said idler. 0n leaving the idler 17, the twisted product is sent to the wire guide pulley 21 rotatably supported by the cradle 9 and then passes to the pulley 22 of what is known as the traversing device. This traversing device which is also supported by the cradle 9 and, under the action of the step-by-step electric motor 23, distributes the twisted product over the axis of the reel 24 with a reciprocating movement parallel to the axis of the said reel, as indicated by the arrows 25. The traversing device (FIG. 3) is associated with a sensor 26 which sends a signal whenever the pulley 22 passes the center of the reel and is also associated with a device 27 which sends an electrical signal proportional to the travel of the said pulley.

On the cradle 9 there are mounted the known means with a head center and tail centre 28–29 for rotating the reel 24, which can be partially moved axially by means of hydraulic actuators. The head center is connected by a positive transmission of motion 30 to a direct current electric motor 31 with a brake and an encoder 131.

On the cradle 9 there is mounted an electric fan 32, with an asynchronous motor, which by means of suitable ducts 132 associated with the said cradle cools the motors 15-23-31. On cradle 9 and, there is also mounted an asynchronous motor and pump unit 33 which forms the hydraulic power unit for the supply of the various hydrostatic actuators.

An electric fan 34 with an asynchronous motor is also provided to cool the motor 6 which rotates the twisting mechanism.

To drive a similar twisting machine or any other twisting machine which presents similar problems, the invention proposes the following.

The motive power supply line 35, which may for example be alternating and three-phase, is connected to a control panel 36 which contains the means necessary for the supply of the motor 6 and of the corresponding electric fan 34. The tachometric generator 106 of the motor 6 is connected to an electronic circuit inside the panel 36 which controls the operation of the motor 6 with the necessary acceleration and deceleration slopes in the phases of starting and stopping each winding cycle. In the panel 36 there are provided the conversion components which provide the direct current necessary for the supply of the unit 6-106 and of the various electronic programming and control circuits associated with this panel, as stated subsequently.

Another motive power line 135 leaves the panel 36 or is branched directly from the line 35, and is linked to a slip ring and brush 37 mounted on the outer end of the spindle 2. A corresponding slip ring and brush 137, electrically interconnected with the former, is provided on the end of the same spindle which is inside the twisting machine. The line 235 leaving this internal slip ring and providing the alternating current power supply to a control panel 38 is fixed to one side of the cradle 9, as clearly shown in FIG. 2. In the panel 38 there are provided all the means necessary for the alternating current supply of the motors of parts 32–33 and to provide the direct current necessary for the supply of all the other motors and of the other internal components of the twisting machine.

The operation of the various internal parts of the twisting machine is controlled by an electronic computer 39 disposed in the internal panel 38. A similar electronic computer 40 is provided in the external panel 36 and is connected to the aforesaid computer 39 through the serial lines 41–141. Serial lines 41–141 may for example be of the two-wire type, and are linked to corresponding slip rings 42–142 interconnected electrically and disposed on the opposite ends of the spindle 2. The computers 39 and 40 can be programmed through the serial lines and a keyboard and screen unit 43 mounted on the external panel 36. The internal computer 39 can communicate through the same serial lines with the external computer 40 to supply all the data necessary to ensure that the external parts of the twisting machine operate in phase and in ordered sequence with the internal parts of the said twisting machine.

To improve the safety of operation of the twisting machine, there are provided, on the opposite ends of the spindle 2, another two slip rings and brushes 44–144 interconnected electrically and linked to corresponding two-wire lines 45–145 whose other ends are linked in turn to the external panel 36 and to the internal panel 38 respectively. Through lines 45–145 it is possible to operate, automatically, semi-automatically and/or manually, the intervention of safety means which stop the twisting machine at the correct time in case of malfunction, by applying the brakes of the various electric motors and the callipers 46–146 of the disc brakes associated with the spindles 2–102 (FIG. 1).

All the electronic units necessary for the correct operation of the winder at an electronically controlled speed are provided in the internal control 38. The unit 47, for example, controls the driving motor 15 of the capstans for drawing the twisted product, and the encoders 115–16 are connected to this unit to ensure that the said motor 15 can be operated in phase with the external motor 6.

The unit 48 controls the winding motor 31 with a progressively decreasing speed which is automatically calculated by the said unit according to the data sent to it from the encoder 131–115, from the transducer 20 associated with the idler 17, and from the adjacent unit 49. Unit 49 controls the motor 23 of the traversing device, and is connected is the said parts 26 and 27.

Another unit 50 operates in logical sequence the various solenoid-operated valves associated with the hydrostatic actuators of the machine.

Clearly, the technical solution described here finally permits the production of a twisting machine, with internal gathering and with a winder with electronically controlled speed, of high technological reliability and having a slip ring system with only five or seven rings and consequently also having the advantages of constructional simplification and reduction of overall dimensions derived from this condition.

It is to be understood that the description refers to a preferred embodiment of the invention, to which numerous variations and modifications, especially in respect of construction, may be made without thereby departing from the guiding concept of the invention, as disclosed above, as illustrated and as claimed below.

I claim:

1. A twisting machine for producing a twisted product comprising:

a supporting frame;

a pair of opposed spindles attached to said supporting frame;

a flyer structure rotatably mounted on said pair of opposed spindles;

a cradle frame supported by said spindles inside of said flyer structure, said cradle frame including a take-up reel for the twisted product;

external components located outside of said flyer structure, each said external component having an external power supply line and an external control line associated therewith;

an external control panel arranged exteriorly of said flyer structure and including (a) a three-phase current power feed line, (b) a supply means for supplying a three-phase current power from said feed line to said supply lines of said external control components, and (c) an external electronic computer having a two-wire serial line and being connected to said external control lines for controlling of said external components;

internal components located inside of said flyer structure, each said internal component having an internal power supply line and an internal control line associated therewith;

an internal control panel mounted on said cradle and including an internal electronic computer having a two-wire serial line and being connected to said internal control lines for controlling of said internal components; and a slip ring system arranged on one of said spindles comprising (a) a first pair of three rings for connecting said feed line with said supply lines of said internal components, and (b) a second pair of two rings for connecting said two wire serial lines of said internal and said external electronic computers together to enable a mutual communication and dialogue between said internal and said external electronic computers to ensure that the operation of said external components takes place in phase and in correct sequence with the operation of said internal components.

2. A twisting machine as claimed in claim 1 further including internal safety devices connected to said internal control panel and external safety devices connected to said external control panel; and wherein said slip ring system further includes a third pair of two rings for connecting a second external two-wire serial line of said external control panel with a second internal two-wire serial line of said internal control panel to enable a mutual communication and dialogue between said internal and said external electronic computers to ensure that an operation of said external safety devices takes place in phase and in correct sequence with an operation of said internal safety devices.

3. A twisting machine as claimed in claim 1 further including a keyboard and screen unit provided on said external control panel and connected to said first electronic computer for programming and interrogating of said internal and said external electronic computers.

* * * * *